US005692985A

United States Patent [19]

Hirata et al.

[11] Patent Number: 5,692,985

[45] Date of Patent: Dec. 2, 1997

[54] CHAIN ASSEMBLY WITH VARYING TRACK LEVELS

[75] Inventors: Takashi Hirata; Kazuhito Matsuura, both of Tokyo-to, Japan

[73] Assignee: Konami Co., Ltd., Hyogo-ken, Japan

[21] Appl. No.: 579,458

[22] Filed: Dec. 27, 1995

Related U.S. Application Data

[62] Division of Ser. No. 345,676, Nov. 28, 1994, Pat. No. 5,501,455.

[30] Foreign Application Priority Data

Nov. 26, 1993 [JP] Japan ..... 5-296440
Nov. 26, 1993 [JP] Japan ..... 5-296441

[51] Int. Cl.[6] ..... F16G 13/02; A63F 9/14

[52] U.S. Cl. ..... 474/210; 273/108.1; 463/68

[58] Field of Search ..... 273/85 R, 86 R, 273/86 B, 108.1; 474/206, 210, 202, 231, 209, 273; 463/58, 68, 62, 63, 64, 65, 69

[56] References Cited

U.S. PATENT DOCUMENTS

| | | | |
|---|---|---|---|
| 2,293,029 | 8/1942 | Focke | 474/231 |
| 2,297,813 | 10/1942 | Stork | 474/210 |
| 2,550,995 | 5/1951 | Gran | 474/210 |
| 2,893,540 | 7/1959 | Freeman | 474/210 |
| 3,441,277 | 4/1969 | Winn | 273/86 F |
| 4,250,764 | 2/1981 | Grant | 474/207 |
| 4,290,762 | 9/1981 | Lapeyre | 474/210 |
| 4,459,124 | 7/1984 | Newton | 474/210 |

FOREIGN PATENT DOCUMENTS

| | | | |
|---|---|---|---|
| 3810823 | 6/1963 | Japan . | |
| 4626490 | 9/1971 | Japan . | |
| 4657559 | 3/1973 | Japan . | |
| 441 | 1/1913 | United Kingdom | 474/210 |

*Primary Examiner*—Sebastiano Passaniti
*Attorney, Agent, or Firm*—Jordon and Hamburg

[57] ABSTRACT

A racing game machine includes an endless plate member formed with running lanes on a top surface thereof, the endless plate member having a grade-separated intersection portion; endless transporting chains provided below the endless plate member, each endless transporting chain having a magnetic portion; guide members provided below the endless plate member, each guide member being operable to hold one of the endless transporting chains within respective courses corresponding to the running lanes; a moving mechanism operable to move the endless transporting chains independently of one another along the respective guide members; running objects each having a magnetic portion; and a controller operable to control the moving mechanism in accordance with a predetermined game program.

4 Claims, 7 Drawing Sheets

CHAIN ASSEMBLY WITH VARYING TRACK LEVELS

This is a division of application Ser. No. 08/345,676, filed Nov. 28, 1994 now U.S. Pat. No. 5,501,455.

BACKGROUND OF THE INVENTION

This invention relates to a racing game machine provided with a model course with varying track levels on which miniature racing cars, horses or the like are raced in competition as in an actual automobile race or horse race.

A conventional arrangement for racing game comprises a model resembling the structure of a horse racing track or automobile racing track on which a plurality of racing objects imitating racehorses, racing cars or the like are moved to compete their speeds.

In one conventional racing game machine, each racing object contains a drive motor to render the racing object to move on the racing track. To enable the racing object to move at high speeds, it is inevitable that the drive motor to be accommodated in the racing object is bulky. Also, controlling parts should be installed on the racing object itself to control its own move. For these and other reasons, this type of racing game machine has the problem that its overall physical construction becomes sizable, taking up a considerable space, and requiring a large amount of equipment costs.

To solve the aforementioned problems, there has been proposed another conventional racing game machine having a model course along which groove-shaped guide members are mounted, each guide member accommodating an endless transporter, such as chain, belt. In this approach, each racing object is configured to follow the endless transporter which is cyclically moved along the racing track with the aid of drive means separately provided from the racing object. In this configuration, the attractive force of a permanent magnet is usually utilized to enable the racing object to follow the endless transporter.

In the second conventional racing game machine, it is possible to construct the racing object in a relatively smaller size because there is no need to mount any motor or control device on the racing object. Furthermore, wiring of signal lines is easier because each racing object can be controlled by transmitting appropriate signals to drive means provided separately from the racing object at a fixed position.

In the conventional racing game machine provided with an endless transporter described above, the endless transporter moves around a guide member while sliding against its bottom and side walls. Since the resultant sliding friction is so great that the drive means is required to provide a driving force large enough to overcome frictional resistance for cyclically moving the endless transporter at high speeds. Furthermore, the endless transporter and guide member are apt to wear with the effect of sliding friction, resulting in a shortened useful life and frequent need for replacement of mechanical parts.

Formed by a number of mechanical elements such as rings and link members connected together, a chain is a kind of connecting string widely used for transmitting mechanical power in wrapping connector driving systems. Although the chain is heavier than a wire rope or belt, which are other forms of connecting string, the chain provides good flexibility, ease of length adjustment, and sure transmission of mechanical power. Chains are used in a wide variety of applications especially because they provide high reliability when accurate synchronization is required in a power transmission process.

Usually mounted between a sprocket attached to a driving rotary shaft and another sprocket attached to a driven rotary shaft, a chain is used to convey torque from the driving rotary shaft to the driven rotary shaft.

Such a chain is particularly useful means for power transmission when the distance between the two shafts is relatively long. In some cases, the chain is employed to use its own mechanical motion rather than for transmitting power to the driven shaft. As already mentioned, such an application of the chain is seen in some racing game machines.

In the case of using a chain as the endless transporter, it is only possible to construct a model course with a flat surface since the chain can only be bent on a single plane. Accordingly, the chain-driven system has a drawback that it is impossible to configure a racing circuit with varying track levels as is usually the case with actual automobile racetracks.

On the other hand, in the case of using a belt as the endless transporter, it would be possible to configure a racing circuit with varying track levels. However, since a belt can be freely bent or deformed due to its own flexibility, it is likely to swing from side to side or up and down while moving through the grooved-shaped path within a guide member. One problem that arises from this instability in the belt looping process is that the racing object is hardly guided by the magnet's attracting force in a stable manner. In this situation, the racing object is liable to run off the magnet-guided circuit during a racing game, and the endless transporter continues to go around without carrying any racing object.

In addition, a racing track having track level variations will include not only a curved portion formed on a horizontal plane but also up and down slopes. Such complication in course construction causes considerable damages to guide members and endless transporters due to accelerated mechanical wear. Under such circumstances, none of the conventional racing fame machines including endless transporters have had courses with level differences and the consequential lack of fun in racing games have been regarded as drawbacks of these machines.

SUMMARY OF THE INVENTION

It is an object of the present invention to provide a racing game machine which has overcome the problems in the conventional racing game machines.

It is another object of the present invention to provide a racing game machine which is provided with a track having a varied level.

It is yet another object of the present invention to provide a chain which is bendable on both a horizontal plane and a vertical plane and can be thus used for a racing game machine having varying track levels.

A racing game machine of the present invention comprises: an endless plate member formed with a plurality of running lanes on a top surface thereof, the endless plate member having a grade-separated intersection portion; a plurality of endless transporting chains provided below the endless plate member, each endless transporting chain having a magnetic portion at a specified portion; a plurality of guide members provided below the endless plate member, each guide member being operable to hold one of the plurality of endless transporting chains within respective courses corresponding to the plurality of running lanes formed on the top surface of the endless plate member; a moving mechanism operable to move the plurality of endless transporting chains independently of one another alone the respective guide members; a plurality of running objects each having a magnetic portion, each running object being magnetically bound to each endless transporting chain by magnetic attraction between the magnetic portion of the running object and the magnetic portion of the endless transporting chain and moved together with the movement of the endless transporting chain; and a controller operable to control the moving mechanism in accordance with a predetermined game program.

The endless transporting chain may be constructed by a plurality of link members; a plurality of connecting pins to connect the plurality of link members with one another, an axis of one connecting pin being shifted right-angle from an axis of another connecting pin. Further, the endless transporting chain may be provided with rollers rotatably provided on the plurality of connecting pins, respectively, a portion of the circumference surface of the roller being outside of the link member.

The guide member may be constructed by a channel portion having both side walls and a bottom wall to define a groove in which the endless transporting chain is accommodated.

The moving mechanism may be constructed by a plurality of moving units operable to move the plurality of endless transporting chains respectively. The moving unit may be constructed by a drive motor controlled by the controller and having a drive shaft; and a sprocket fixedly attached on the drive shaft and engaged with a specified endless transporting chain.

It may be appreciated to provide et least one magnet piece on a top of a specified link member while to provide at least one magnet piece on a bottom of the running object. Also, it may be appreciated to make at least one specified link member by a magnetic material in place of providing a magnet piece on a top of the endless transporting chain. Further, it may be appreciated to make at least one specified roller by a magnet without providing a magnet piece on a top of the endless transporting chain. Furthermore, the controller may be provided with magnetic sensors at respective specified portions of the courses corresponding to the running lanes to detect the running objects.

It may be appreciated to form the endless plate member into the shape of the figure eight.

Moreover, the present invention is directed to a chain comprising: a plurality of link members; a plurality of connecting pins to connect the plurality of link members with one another, an axis of one connecting pin being shifted right-angle from an axis of another connecting pin. The chain may be preferably provided with a roller rotatably provided on each of the plurality of connecting pins, a portion of the circumference surface of the roller being outside of the link member.

With thus constructed racing game machine, the running object is moved by the endless transporting chain. Accordingly, it is not necessary to mount a drive device on each running object, which will reduce the production costs of a game machine. Also, because being transported by the endless transporting chain, the running object can be assuredly transported without the likelihood of falling off from the track. Further, the running object is magnetically bound to the endless transporting chain, which enables the running object to be removably set on the track with ease.

The track is made of the endless plate member. Comparing with machines having a non-endless and straight track, the machine of the present invention can ensure a long running length without increasing the size of machine. Also, the endless plate member has a grade-separated intersection portion, which will sire players an increased fun.

The endless transporting chain is made of a series of link members. The respective axes of the connecting pins connecting the link members are made to be shifted right-angle from one another to make the chain bendable both on a vertical plane and a horizontal plane. Accordingly, the endless transporting chain can be moved closely along the endless plate member having a grade-separated intersection portion. Further, the connecting pin is rotatably attached with a roller a circumference surface portion of which is outside of the link member. This will keep the link member from coming into contact with the guide member, and assure smooth movement of the endless transporting chain in the guide member.

The guide member has a channel portion having side walls and a bottom wall. The bottom wall serves as a support for the endless transporting chain. Accordingly, the endless transporting chain can be guided and supported by a simpler construction.

The moving mechanism is constructed by a plurality of moving units operable to move the plurality of endless transporting chains respectively. Accordingly, independent movements of the plurality of running objects can be controlled with ease. The endless transporting chain is connected with the drive motor by way of a sprocket. This will assure the transmission of the torque of drive motor to the endless transporting chain.

Magnet pieces are provided on a top of a specified link member and on a bottom of the running object, respectively. This will provide a stronger magnetic attraction between the running object and the endless transporting chain.

Magnet pieces are provided on the running object while specified links of the chain are made of a magnetic material, or specified rollers of the chain are made of a magnetic material. This will simplify the construction of the chain.

The endless plate member is provided with magnetic sensors on the respective running lanes to detect the movement of the running object, which makes possible automatic control of the movement of the running object.

The endless plate member which has the figure-eight can assure the same length for the plurality of running lanes provided on the endless plate member.

With the chain constructed by a plurality of link members and a plurality of connecting pins whose axes are made to be shifted right-angle from one another, the link member is rotatable both about the connecting pin extending a vertical direction and about the connecting pin extending a horizontal direction. In other words, the chain can be bent both on a horizontal plane and a vertical plane. Accordingly, this chain can be used in a complicatedly curved transporting path or course, such as running track of a racing game machine.

The roller which is rotatably attached on the connecting pin and a circumference surface portion of which is outside of the link member will assure smooth sliding on a guide member.

These and other objects, features and advantages of the invention will become more apparent upon a reading of the following detailed description of the preferred embodiments with reference to the appended drawings.

DETAILED DESCRIPTION OF THE PREFERRED EMBODIMENTS OF THE INVENTION

Figure 1:
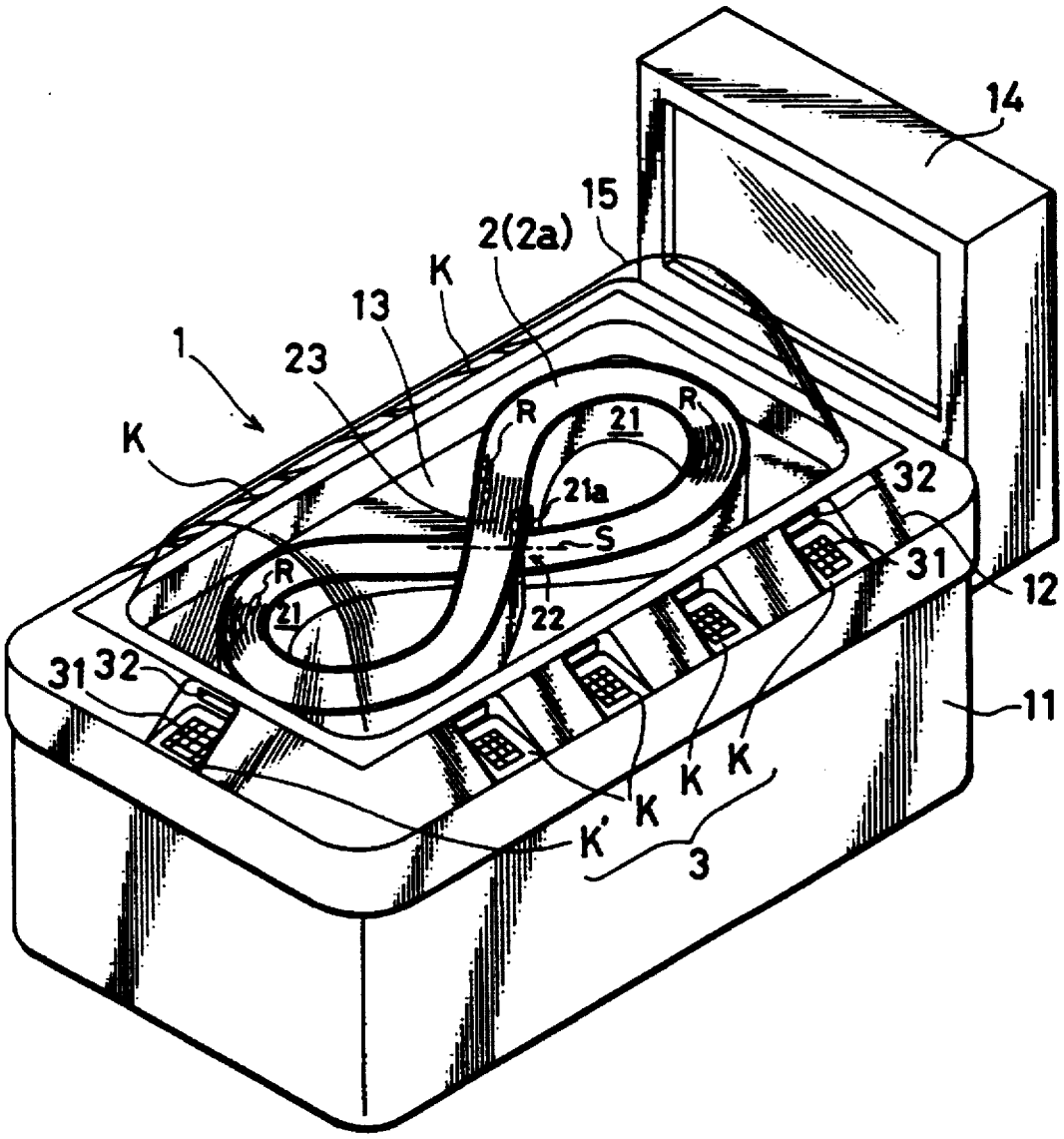
FIG. 1 is a perspective view showing a racing game machine having track level variations as a preferred embodiment of the present invention.

FIG. 1 is a perspective view of a racing game machine provided with a model course with varying track levels according to the present invention. As shown in FIG. 1, the game machine 1 comprises a platform 11 in the form of a rectangular parallelepiped, a panel 12 placed on a top of the platform 11, and a field portion 13 surrounded by the panel 12. Also, there is shown a display unit 14 standing at one side of the platform 11 with its display screen facing the field portion 13. However, such a display unit is not an absolute requirement of the present invention. It may be omitted in some cases. The whole of the field portion 13 is covered with a transparent dome cover 15, which protects below-described various facilities on the field portion 13.

There is provided a racing track 2 having the shape of the figure eight when viewed from above in the field portion 13. The racing track 2 is formed on top of an embankment 21 raised to specified varying height from the surface of the field portion 13.

At the crossing of the figure-eight racing track 2, there is made a tunnel 21*a* passing through the embankment 21. On the lower track portion, there are a downward sloping to the tunnel 21*a* and an upward sloping from the tunnel 21*a*. The crossing of the racing track 2 is therefore a grade-separated intersection 22, where one part of the embankment 21 passes through the tunnel 21*a* formed in the other part of the embankment 21. The racing track 2 of the present invention is not limited to the one constructed on the embankment 21 but may be formed on the same plane as the field portion 13 with a viaduct overpassing at only the point of grade separation.

A plurality of parallel lanes 23 are formed on a track surface 2*a* of the figure-eight racing track 2 and a racing object, or a racing car R, is arranged on each lane 23. Each racing car R moves on its lane 23 with aid of a drive mechanism to be described later in detail and controlled by a control unit 6 shown in FIG. 7.

Figure 3:
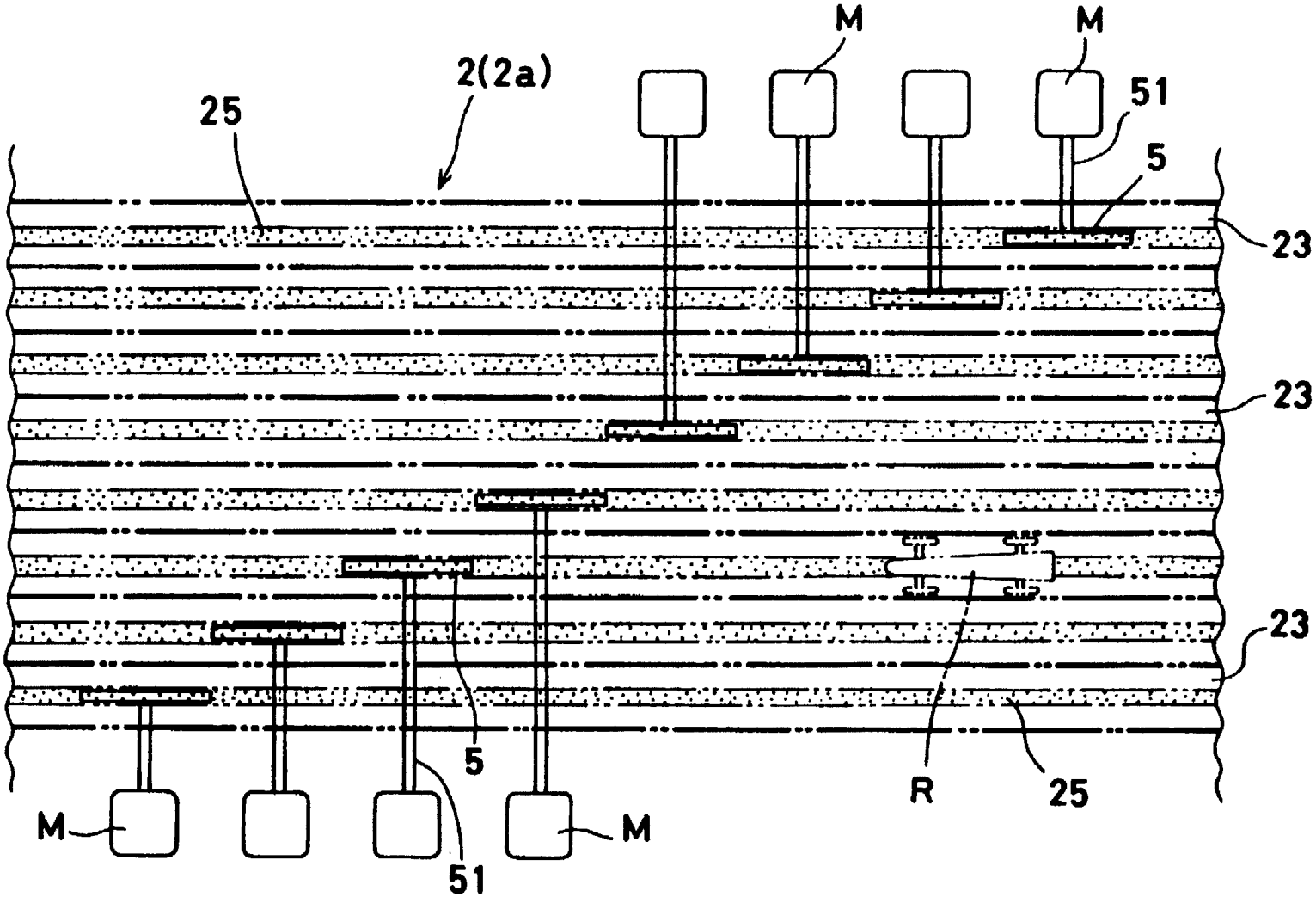
FIG. 3 is a plan view showing a plurality of lanes arranged on a racing track.
Figure 7:
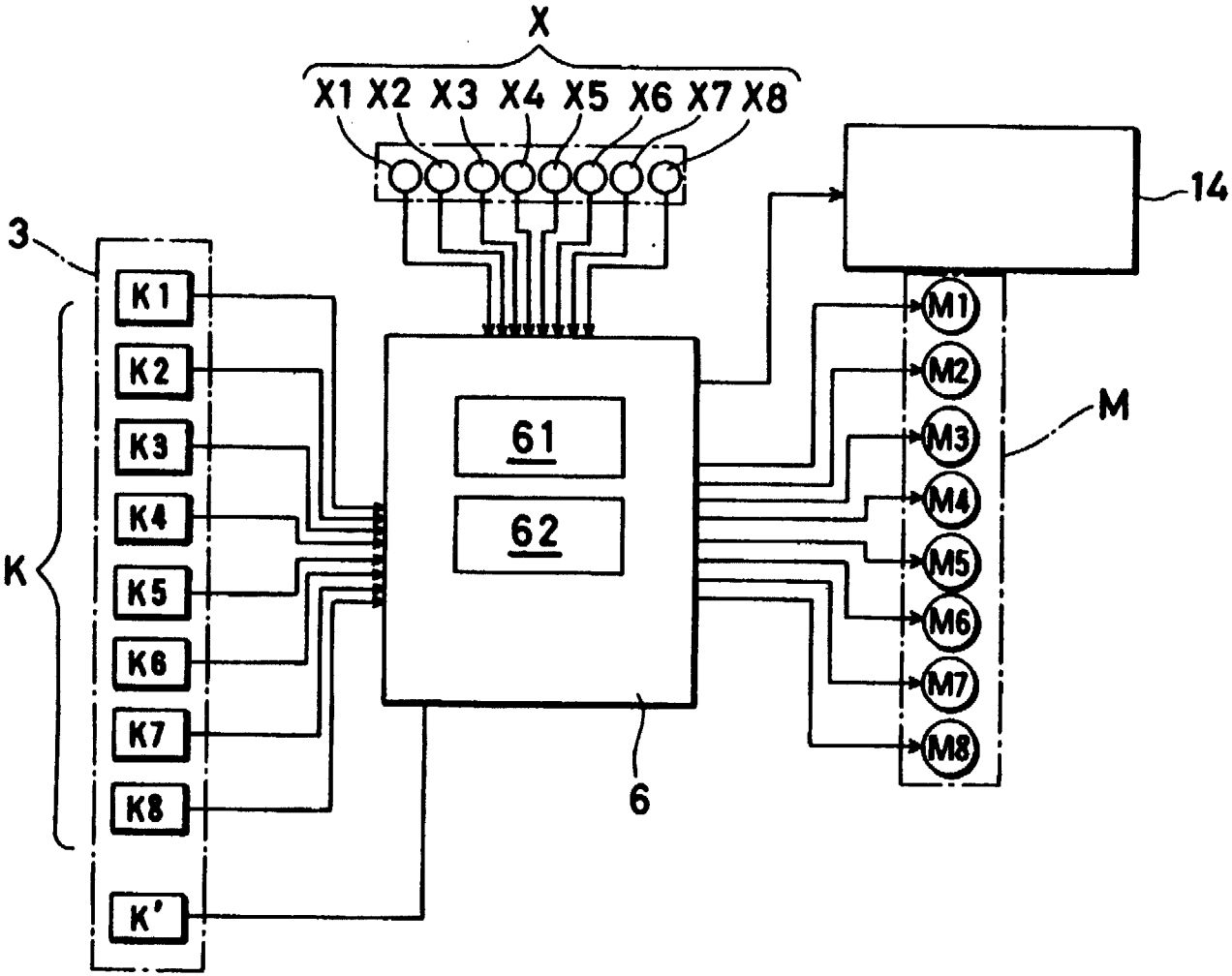
FIG. 7 is a block diagram showing a control system of the racing game machine.

In this embodiment of FIGS. 1, 3 and 7, the racing track 2 is provided with eight lanes 23. However, the number of lanes is not limited to eight according to this invention. There may be provided less than eight or more than eight lanes, as appropriate.

There are provided a plurality of input terminals K for players in the panel 12 and they are arranged to surround the field portion 13. Each input terminal K includes a numeric readout 32 which indicates, for example, numbers representing combinations of racing cars R that might finish in the first and second places together with their odds for betting prior to the start of a game. Each player enters a bet for a desired combination of racing cars R via his or her input terminal K in consideration of the indicated combinations and their odds. These input terminals K constitute an input unit 3 of the game machine 1.

In the game machine 1, racing games are automatically started at preset time intervals. More specifically, the control unit 6 contains a timer for setting a time period required for conducting one race. The racing cars R line up at a reference position S, start out all together and perform a racing game, and this sequence is finished within the set time period.

In this embodiment, the reference position S is set at the location of a dot-and-dash line shown on the track surface 2*a* just above the tunnel 21*a* at the grade-separated intersection 22 in FIG. 1. The start line location is not limited to that position, however, and it may be set at any appropriate position on the track surface 2*a*.

The moving speed of each individual racing car R is set in the control unit 6 based on a statistical calculation performed taking account of the above-mentioned odds. Therefore, a racing car R at lower odds has a greater chance of finishing at higher ranking than a racing car R ranked at higher odds from the statistical point of view. This does not necessarily mean that a racing car R of higher odds is always defeated in individual racing events, though.

Individual players can participate in a racing game by entering bets through their input terminals K with reference to the odds indicated on the numeric readouts 32 before the racing cars start out, within the aforementioned time period. Although there are provided eight input terminals K in this embodiment, it is not absolutely necessary that all the eight input terminals K be operated simultaneously. Racing games are started at predefined time intervals no matter whether the number of players is less than eight. This means that the racing game would be started even if no players participates in this racing game.

As an alternative to the above-described sequence, racing games may be performed in the following manner. Specifically, each input terminal K includes a numeral input keypad 31 including numeric keys 0 to 9, an input confirmation key, a cancel key, etc. in addition to the numeric readout 32 which instantly indicates input data of a player. When the player enters an amount of bet by operating the numeral input keypad 31, the value of odds proportional to the reciprocal of the entered amount of bet is indicated on the display unit 14. At this point, the player can alter the amount of bet as appropriate with reference to the displayed value of odds. Each racing game is started when all participating players have confirmed their bets by operating the input confirmation keys. In this approach, it may be possible to make the racing game more enjoyable, reflecting the participating players' intentions and interactions among them. A method of controlling such a racing game sequence will be described later in detail referring to FIG. 7.

When a racing game is commenced, a plurality of racing cars R placed on individual lanes 23 move competing each other, following the eight-figure runways along the racing track 2 under the control of the control unit 6 to be described later. Each racing car R is stopped when it has passed the reference position S on the track surface 2*a* a specified number of times, and the racing game is finished when all the racing cars R have passed the reference position S the specified number of times. Upon completion of the racing game, the display unit 14 shows finish ranking and final amounts of bets.

Figure 2:
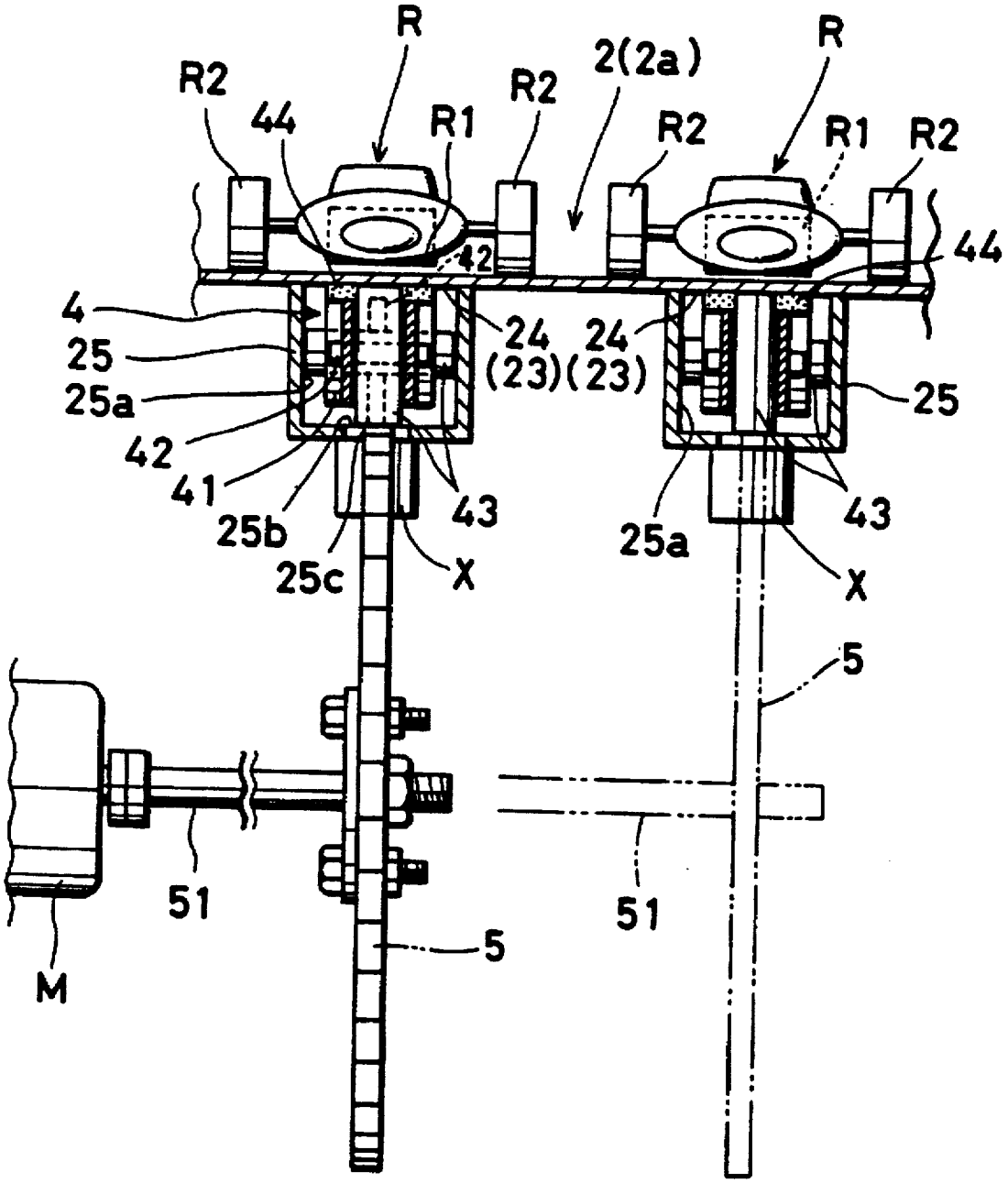
FIG. 2 is a partial sectional view showing an operational relationship between a guide member and an endless transporting chain.
Figure 4:
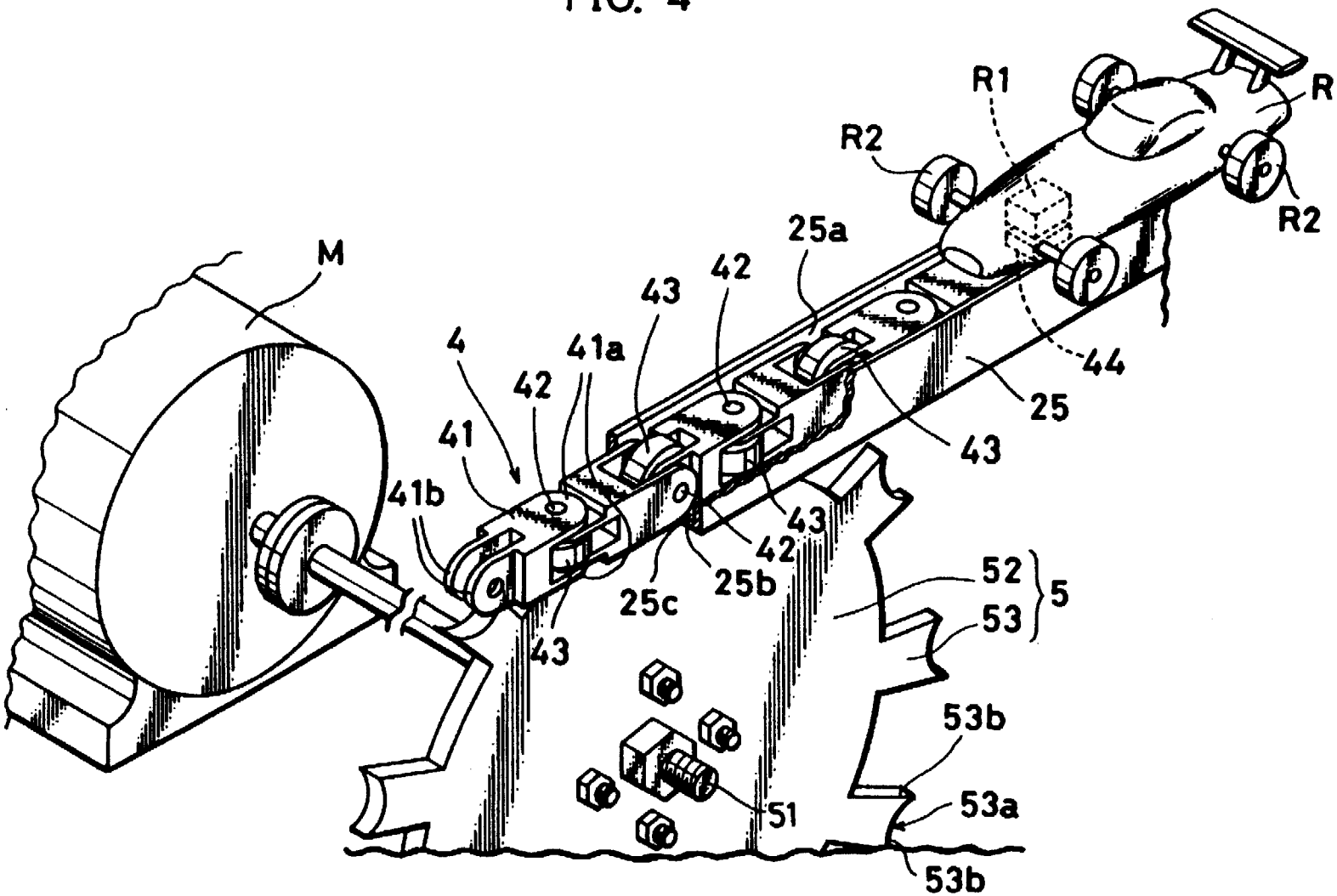
FIG. 4 is a partially cutaway perspective view showing an operational relationship between the guide member, endless transporting chain, and sprocket.

FIG. 2 is a sectional view showing an arrangement of guide members and endless transporting chains. FIG. 3 is a plan view showing a plurality of lanes 28 arranged on the racing track 2. FIG. 4 is a partially cutaway view showing a guide member, endless transporting chain and sprocket.

As shown in these diagrams, the racing track 2 Is made of a thin plate member 24 which is curved into the shape of the figure eight having a grade-separated intersection. Guide members 25, each having the form of a channel, are provided on an underside of the plate member 24.

Each guide member 25 has a U-shaped cross section with its opening side facing upwards. The opening side of the U-shaped groove is however closed because the guide member 25 is mounted immediately on the underside of the plate member 24. An endless transporting chain 4 is placed in the groove of each guide member 25. The endless transporting chain 4 is curved into the figure eight form.

The chain 4 is constructed by a number of link members 41 connected with one another in series. Specifically, adjacent link members 41 are connected with one another by connecting pins 42. An axis of one connecting pin 42 extends at right angles with an axis of next connecting pin 42.

A connecting pin 42 is rotatably attached with a roller 43. Supported by a pair of connecting pins 42 fitted at right angles at both ends of each link member 41, a pair of rollers 43 are rotatable about the respective connecting pins 42 within mutually perpendicular planes containing the respective pin axes.

The circumference of each roller 43 partially projects from top and bottom surfaces, or left and right surfaces of the link member 41 in a symmetrical manner. As depicted in FIGS. 2 and 4, the circumference of each roller 43 that is made to be rotatable within a horizontal plane about its connecting pin 42 is kept in contact with side walls **25*a* of the guide member 25 while the circumference of each roller 43 that is made rotatable within a vertical plane about its connecting pin 42 is kept in contact with a bottom 25*b* of the guide member 25. Thanks to this arrangement, the link members 41 will not come into direct contact with the inside of the guide member 25**.

The endless transporting chains 4, which each are constructed by connecting a number of link members as seen above, are cyclically moved in the respective guide members 25 by individually provided drive mechanisms.

As shown in FIG. 3, each drive mechanism comprises a drive motor M and a sprocket 5 fitted to a drive shaft 51 of the motor M. The sprocket 5 engages the corresponding endless transporting chain 4 through a slit **25*c* cut out in the bottom 25*b* of the guide member 25 and a torque of the drive motor M is conveyed to the endless transporting chain 4 via the drive shaft 51 and sprocket 5. Therefore, the endless transporting chain 4 circulates in the guide member 25** when the motor M is rotated.

The rollers 43 roll on inside walls of the guide member 25 while the endless transporting chain 4 is circulating in the guide member 25. Accordingly, the link members 41 will not come into contact with the side walls **25*a* or bottom 25*b*. As a result, the endless transporting chain 4 can smoothly travel in the guide member 25 with neglectable friction of the endless transporting chain 4 against the inside walls of the guide member 25**.

An appropriate link member 41 of the endless transporting chain 4 is attached with a first permanent magnet 44 at the portion of a top surface of the link member 41 where the permanent magnet 44 will not interfere the free rotation of the roller 43.

On the other hand, a racing car R which is to be placed just above the first permanent magnet 44 is attached with a second permanent magnet R1 on an underside of the racing car R. This second permanent magnet R1 is held face to face with the first permanent magnet 44 with their opposite poles facing each other with a specified gap between them. It should be noted that this embodiment employs a pair of magnets, i.e., the first permanent magnet 44 and second permanent magnet R1, but it may be possible to substitute one of the magnets for a block of magnetic material such as iron.

Each racing car R has four wheels R2 including two each front and rear wheels rotatably attached to their axles. The racing car R is placed on the surface of the plate member 24. When the endless transporting chain 4 is moved in the guide member 25, the first permanent magnet 44 advances together with the endless transporting chain 4. As the second permanent magnet R1 also advances, attracted by the first permanent magnet 44, the racing car R travels on the surface of the plate member 24 while its four wheels R2 rotating. This will give the players the impression that racing cars R would race along separate lanes 23 on the track surface **2*a***.

Figure 5:
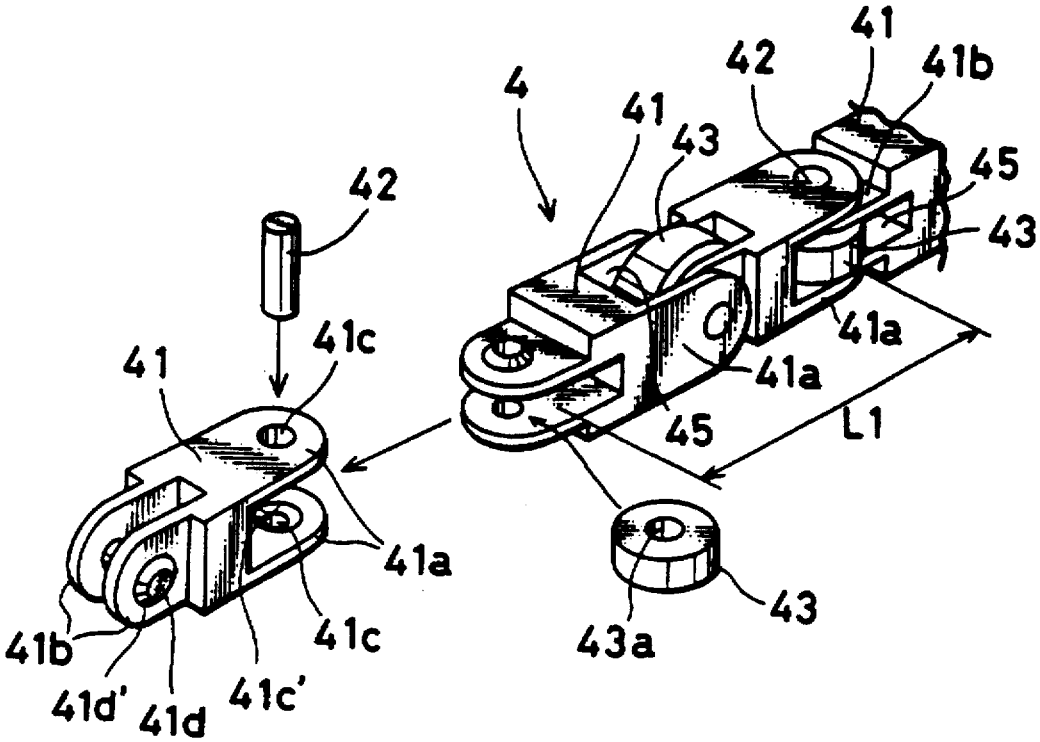
FIG. 5 is a perspective view showing a detailed construction of the transporting chain.
Figure 6:
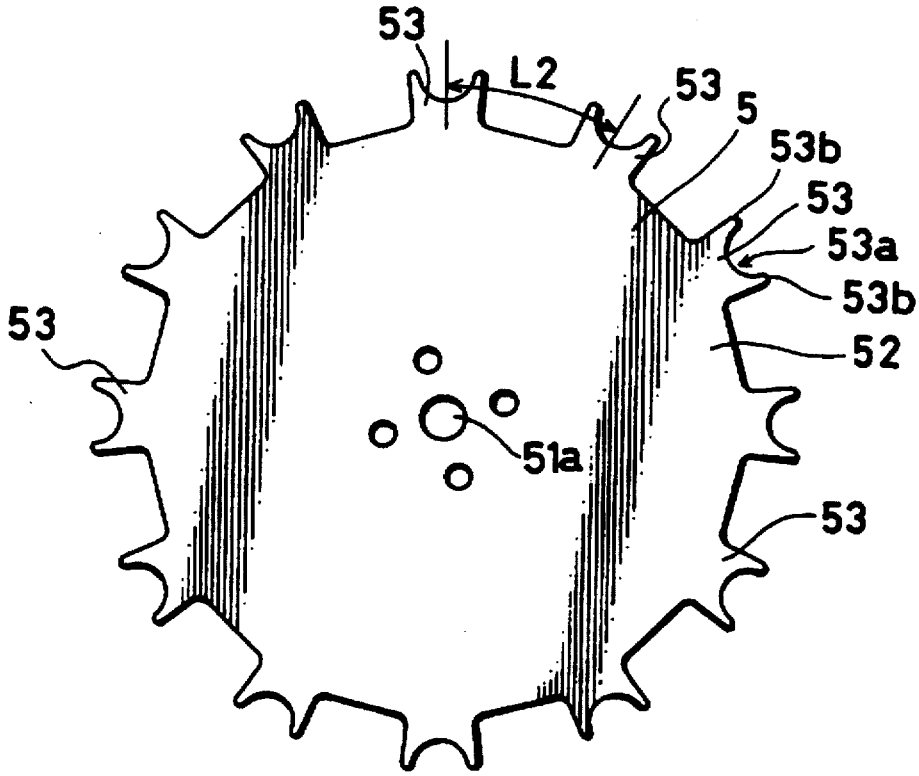
FIG. 6 is an elevational view of the sprocket.

The chain 4 and sprocket 5 which play an important role in this invention will be described in further detail, referring to FIGS. 5 and 6. FIG. 5 is a perspective view illustrating a detailed construction of the chain 4. FIG. 6 is an elevational view of the sprocket 5.

As mentioned above, the chain 4 is constructed by a number of link members 41, connecting pins 42 for connecting adjacent link members 41 and rollers 43 attached on individual connecting pins 42. On one longitudinal end of each link member 41 are formed a pair of first coupling flanges **41*a* extending parallel to each other at a specified spaced. On the other longitudinal end of the link member 41 are formed a pair of second coupling flanges 41*b* separated by a specified space extending at right angles with the first coupling flanges 41*a*. The distance between the first coupling flanges 41*a* is made a little larger than the distance between the second coupling flanges 41*b*. Such an arrangement is made in order that the second coupling flanges 41*b* can be fitted into the gap between the first coupling flanges 41*a***.

A pair of first pin retaining holes **41*c* facing each other are formed in the first coupling flanges 41*a*, and each of the first pin retaining holes 41*c* has a conical countersink 41*c*'. On the other hand, a pair of second pin retaining holes 41*d* facing each other are formed in the second coupling flanges 41*b*, and each of the second pin retaining holes 41*d* has a ring-shaped outward projection 41*d*' geometrically corresponding to the conical countersink 41*c*'**.

Accordingly, when the second coupling flanges **41*b* of one link member 41 are inserted into the gap between the first coupling flanges 41*a* of another link member 41, the projections 41*d*' of the former link member 41 fit into the countersinks 41*c*' of the latter link member 41 so that the two link members 41** are mated together.

With the two link members 41 readily connected in this manner, a roller 43 having a center hole **43*a* is placed between the second coupling flanges 41*b*. Next, a connecting pin 42 is inserted into the first pin retaining hole 41*c* and second pin retaining hole 41*d* on one side, the center hole 43*a* of the roller 43, and the second pin retaining hole 41*d* and first pin retaining hole 41*c*** on the other side in this order.

Both ends of the connecting pin 42 is then caulked so that the two link members 41 are connected with each other.

Since the diameter of each roller 43 is larger than the width of either the first coupling flanges 41*a* or second coupling flanges 41*b*, the circumference of the roller 43 partially projects outward from the link member 41 when the roller 43 is fitted on its connecting pin 42 as described above. A number of link members 41 are connected with one after another in this way to form a chain. Both end link members 41 of the chain are then connected to each other to form an endless transporting chain 4.

In the state of a roller 43 being mounted to the chain 4, there are defined a pair of interlocking pits 45, into which teeth of the sprocket 5 will engage, along the longitudinal axis of the chain 4, one interlocking pit 45 being located between the roller 43 and the first coupling flanges 41*a* and the other between the roller 43 and the second coupling flanges 41*b*. These interlocking pits 45 are created in pairs on mutually perpendicular sides of the chain 4 alternately. Therefore, the pitch of the chain 4 is defined as distance L1 between the centers of every second rollers 43 that are rotatable within the same plane about their connecting pins 42.

As seen above, the chain 4 has a series of rollers 43 of which planes of rotation are alternately arranged at right angles so that their circumferential portions project from the link members 41 in vertical and horizontal directions alternately. This is why the circumferences of the rollers 43 are held in contact with the side walls 25*a* and bottom 25*b* of the guide member 25. As a result, mechanical wear of the chain 4 and guide member 25 is effectively reduced and the endless transporting chain 4 smoothly travels within the guide member 25.

The elements of the chain 4 are made of synthetic resin materials using injection molding technology. The choice of synthetic resin materials is not limited to any specific types, but any suitable materials may be used. To give some examples, it is possible to use such general-purpose synthetic resins as polyethylene, polypropylene, polystyrene, acrylonitrile butadiene styrene (ABS), polymetyl methacrylate (PMMA) or polyvinyl chloride (PVC).

It is also possible to use such high-performance engineering synthetic resins as polyamide, polyacetal, polycarbonate, polyphenylene ether, polybutylene terephthalate, polysulfone, polyether-sulfone, polyphenylene sulfite, polyarylate, polyamide, polyamide imide, polyether ether ketone or polytetrafluoroethylene (PTFE). From the viewpoint of mechanical toughness and durability, it is preferable to use engineering synthetic resins.

The use of synthetic resin materials makes it possible to reduce the weight of the chain 4. It also serves to ensure smooth movement of the chain 4 even without application of lubricating oil, reduce work load required for daily maintenance including lubrication, and eventually provide substantial savings of equipment and operating costs.

Referring now to FIG. 6, the sprocket 5 for driving the chain 4 will be described. The sprocket 5 includes a thin disc 52 having a through hole 51*a* at its center and a series of radially projecting teeth 53 from the circumference of the disc 52. The outermost part of each tooth 53 is formed with an arc-shaped edge 53*a* which will align with the circumference of each roller 43 and a pair of projecting tips 53*b* at extreme ends of the arc-shaped edge 53*a* are formed to fit into the interlocking pits 45 defined at the forward and backward sides of each roller 43 of the chain 4.

Circular distance L2 measured around the through hole 51*a* from the center of the arc-shaped edge 53*a* of one tooth 53 to the center of the arc-shaped edge 53*a* of an adjacent tooth 53 is made equal to distance L1 between the centers of every second rollers 43 that are rotatable within the same plane about their connecting pins 42. The chain 4 is wrapped around the sprocket 5 and each roller 43 is held by a tooth 53 of the sprocket 5 to transmit the torque of the sprocket 5 to the chain 4, causing it to move cyclically within the guide member 25.

Referring next to FIG. 7, the control of the racing game machine 1 having track level variations will be described below in detail. It is to be noted in this connection that the control of the game machine 1 is not limited to the one described hereunder. FIG. 7 is a block diagram illustrating a control system of the racing game machine 1 having track level variations.

As shown in FIG. 7, the control system includes the previously mentioned input unit 3 for entering amounts of bets for individual racing objects (or racing cars R), passage sensors X, each including a magnetic sensor element for detecting a racing car R passing the reference position S provided on the track surface 2*a* of the racing track 2, the display unit 14 for indicating information on racing games, and the control unit 6 for controlling the progress of racing games.

As already described, the input unit 3 includes eight input terminals K1–K8, each having a numeral input keypad 31 for entering numeric data and a numeric readout 32 for verifying input results. When a player enters numeric data by operating numeric keys and presses the input confirmation key after verifying his or her input data (or the amount of bet) shown on the numeric readout 32, a resultant input signal is immediately delivered to the control unit 6.

The passage sensors X are mounted on the bottom of the individual guide members 25 as shown in FIG. 2. Including a magnetic switch for magnetically sensing the existence of a magnetic material, each passage sensor X detects a passage of a racing car R carrying the second permanent magnet R1. The passage sensors X are located at the reference position S shown in FIG. 1 in this embodiment.

Although the embodiment employs magnetic switches as sensor elements, the type of sensors is limited thereto. In a modified form of the embodiment, optical sensors may be adopted as the passage sensors X. In this case, a passage by the reference position S could be detected when an optical path formed between an optical transmitter and receiver of each optical sensor is interrupted by a racing car R.

In this embodiment, there are provided eight passage sensors X1–X8 individually attached to the guide members 25 which form the eight-lane racing track 2. These passage sensors X1–X8 transmit the results of passage detection to the control unit 6. There are also provided eight drive motors M1–M8 for cyclically moving the endless transporting chain 4 within their respective guide members 25.

The control unit 6 includes a racing object speed controller 61 for controlling startup, rotation and stoppage of the individual drive motors M based on information entered from the input unit 3 and detection signals fed from the passage sensors X1–X8, and an odds calculator 62 for calculating odds in accordance with amounts of bets.

The racing object speed controller 61 stores a program for controlling start and stoppage of the individual drive motors M1–M8 and rotational speed settings of the individual drive motors M1–M8 based on random numbers, for instance, that determine start and finish positions of the individual racing cars R. The racing object speed controller 61 outputs control signals to the individual drive motors M1–M8 for controlling them in such a manner that the finish ranking of the individual racing cars R is determined in accordance with probabilities which correspond to the reciprocal of the odds, using statistical techniques.

In this embodiment, rotational speeds of the individual drive motors M1–M8 are set by using the Monte Carlo method, in which uniform random numbers are generated and a mathematical operation is performed using these random numbers and a distribution function (e.g., normal distribution, binomial distribution, or Poisson's distribution).

The racing object speed controller 61 further includes an internal counter which stores the number of times each racing car R has passed the reference position S as detected by its passage sensor Xi. When the number of detected passages of each racing car R reaches a preset value, the racing object speed controller 61 transmits a stop signal to the corresponding drive motor Mi to stop its rotation.

Identification numbers assigned to the individual drive motors Mi are stored in the racing object speed controller 61 in the order of occurrences of stop signals. Then, finish positions of the individual racing cars R are determined based on the order of stop signal transmissions and shown on the display unit 14.

There are provided eight guide members 25 on the track surface 2*a* in this embodiment, the number of guide members 25 is by no means limited to eight. There may be less than eight or more than eight guide members 25, depending on specific needs. Furthermore, the game machine 1 of this embodiment has the large-sized display unit 14 attached to one side of the platform 11, as shown in FIG. 1. It is not absolutely necessary to provide the display unit 14 of such a large size. As an alternative, it would be possible to use the numeric readout 32 of each input terminal K instead of the display unit 14.

Since the control system of the racing game machine 1 with track level variations is constructed as described above, a plurality of participating players begin a racing game by first entering amounts of bets via the numeral input keypads 31 of their input terminals Ki. When all the players have entered their bets, the control unit 6 detects completion of initial betting and transmits an 'end-of-betting' signal to the odds calculator 62.

Upon receiving this signal, the odds calculator 62 calculates odds and the display unit 14 shows the results of odds calculation. At this point, each player can alter his or her amount of bet taking account of the odds shown on the display unit 14. Each player's betting decision is finally accepted when he or she presses the input confirmation key. The racing game is commenced when all the players have pressed their input confirmation keys.

When all the players have entered amounts of bets and pressed their input confirmation keys, the control unit 6 transmits start command signals to individual drive mechanisms to begin the game. Then, the racing object speed controller 61 of the control unit 6 transmits drive command signals to the individual drive motors Mi to control the respective drive mechanisms. As a result, turning speeds of the drive mechanisms are individually varied with time so that the finish ranking of the racing cars R is determined in accordance with probabilities which correspond to the reciprocal of the odds, using statistical techniques.

In this embodiment, each of the drive command signals is a so-called duty-controlled command signal formed by a current pulsating at regular intervals, where the ratio of effective current components is controlled. The command signals are not limited to this type of current signal, however. Alternatively, the command signals may be formed by changing periods of current pulses or by controlling current values themselves. It would also be possible to employ frequency-controlled pulse motors.

As the passage sensors X detect individual racing cars R passing the reference position S, detection signals are successively entered into the racing object speed controller 61 of the control unit 6. The racing object speed controller 61 stores the number of passages of the individual racing cars R by counting the number of occurrences of these detection signals. When a particular racing car R has passed the reference position S a preset number of times, the racing object speed controller 61 transmits a signal for stopping the corresponding drive motor Mi so that the racing car R is stopped subsequently.

The current racing game is finished at a point where all the racing cars R have passed the reference position S the preset number of times. Upon completion of the game, the racing object speed controller 61 stores the finish ranking of the racing cars R and this ranking information is indicated on the display unit 14.

The display unit 14 shows the amounts of bets of the participating players prior to the start of a racing game and the finish ranking of the racing cars R upon completion of the racing game. This does not imply any limitations to the contents of information to be shown on the display unit 14. The display unit 14 may indicate not only the amounts of bets and finish ranking but a variety of guidance messages and other information that will be useful for the players in executing a racing game. Furthermore, video images of an actual race may be shown on the display unit 14 while the racing game is in progress. With this arrangement, the racing game can be performed smoothly and becomes remarkably enjoyable with enhanced reality added by the video image presentation.

Figure 8:
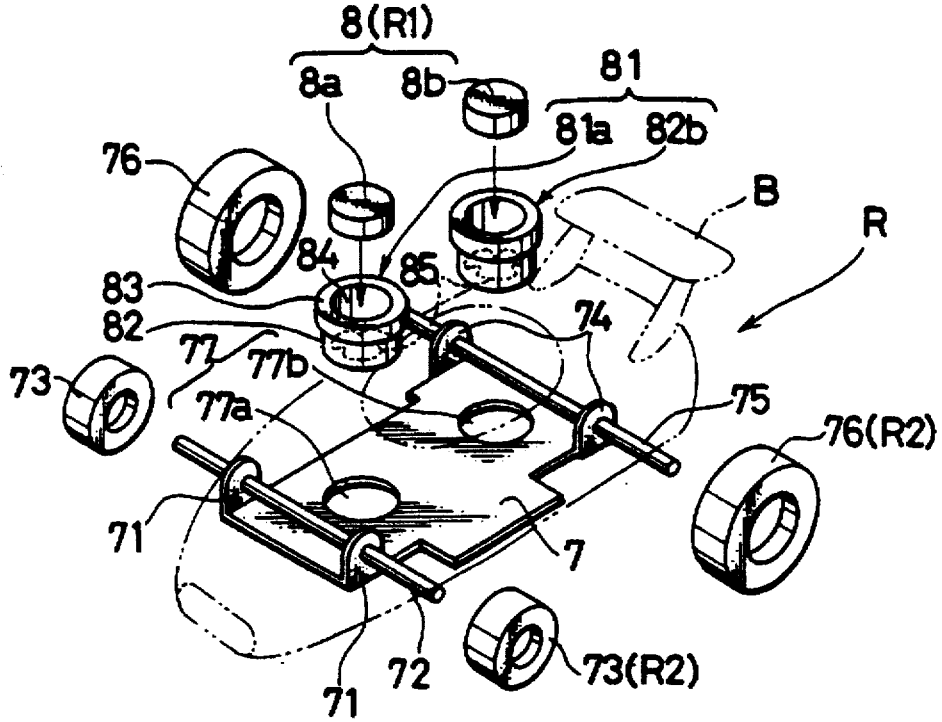
FIG. 8 is an exploded perspective view showing a construction of a racing car used in the racing game machine.

Referring now to FIG. 8, a construction of each racing car R will be described in detail. FIG. 8 is an exploded perspective view showing a construction of the racing car R. As shown in FIG. 8, the racing car R has a chassis 7 as a main internal structural member. At a forward portion of the chassis 7 are formed a pair of front brackets 71 extending upward on both the left and right sides. A front axle 72 is inserted into retaining holes formed one each in the left and right front brackets 71 and the front axle 72 can rotate about its axis. Among the previously mentioned four wheels R2, a pair of front wheels 73 are fitted on both ends of the front axle 72. It would therefore be understood that the left and right front wheels 73 can rotate around the axis of the front axle 72 held by the front brackets 71.

At a rear portion of the chassis 7 are formed a pair of rear brackets 74 extending upward on both the left and right sides. A rear axle 75 is inserted into retaining holes formed one each in the left and right rear brackets 74. Among the previously mentioned four wheels R2, a pair of rear wheels 76 are fitted on both ends of the rear axle 75. Accordingly, the left and right rear wheels 76 can rotate around the axis of the rear axle 75 held by the rear brackets 74.

In FIG. 8, the chassis 7 has front and rear through holes 77*a*, 77*b* for holding a pair of second permanent magnets R1 on the center line of the chassis 7 extending along the longitudinal direction of the chassis 7. Although there are made two through holes 77*a*, 77*b* in FIG. 8, it is also possible to form one, three or more through holes 77 in the chassis 7.

In this embodiment, front and rear magnet cases 81*a*, 81*b* are fitted into the front and rear through holes 77*a*, 77*b*, respectively. Each magnet case 81 has a hollow cylindrical portion 82 forming a magnet compartment 84 inside. The hollow cylindrical portion 82 has an outside diameter to fit in each through hole 77.

At the upper circumferential portion of the hollow cylindrical portion 82 is formed a ring-shaped flange 83, of which outside diameter is made a little larger than the diameter of each through hole 77. Therefore, when the magnet case 81 is fitted into the through hole 77, the flange 83 of the magnet case 81 conveniently mounts on the periphery of the through hole 77, preventing the magnet case 81 from falling off the through hole 77.

The magnet compartment 84 formed in the magnet case 81 accommodates a relatively thin disc magnet 8 which will act as a second permanent magnet R1. More specifically, the front magnet case 81*a* holds a front disc magnet 8*a* while the rear magnet case 81*b* holds a rear disc magnet 8*b*. On the lower inside wall of the magnet compartment 84 are formed a plurality of claws 85 projecting inward to prevent the disc magnet 8 from falling off downward through the magnet compartment 84.

After the chassis 7 has been fitted with the front and rear wheels R2 (73, 76) and one or more magnet cases 81 each containing a disc magnet 8 as seen above, a car body B shown by alternate long and two short dashed lines is mounted on the chassis 7 to finally complete the racing car R. Being placed on a lane 23 on the track surface 2*a*, the racing car R travels along the lane 23, guided by the chain 4 moving underneath. This will the feeling that the racing car R is running by Itself with its wheels R2 rotating, along the lane 23.

Figure 9:
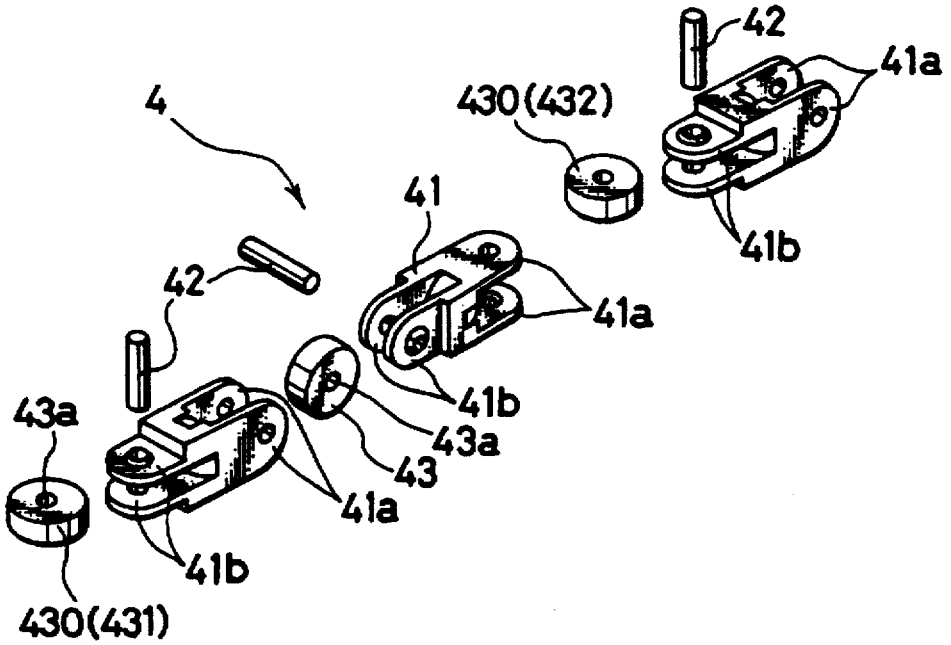
FIG. 9 is an exploded perspective view showing another transporting chain used in the racing game machine.

FIG. 9 is an exploded perspective view of another chain 4. This chain 4 has basically the same construction as the one previously described with reference to FIG. 5. As shown in FIG. 9, the chain 4 is made by connecting a number of link members 41. Specifically, the chain 4 includes link members 41, connecting pins 42 fitted at right angles with one another for connecting two link members 41 each other, and a roller 43 rotatably fitted on the connecting pin 42.

In this chain 4, the roller 43 horizontally mounted on a vertically fitted connecting pin 42 between second coupling flanges 41*b* is a flat disc-shaped permanent magnet, or a magnet roller 430, having a center hole 43*a* passing through its center of rotation.

Since the chain 4 contains such magnet roller 430, the first permanent magnet 44 previously shown in FIGS. 2 and 4 is not attached to the top surface of any link member 41. It should be noted that there are no specific limitations with respect to the number of magnet rollers 430 to be fitted to the chain 4. The chain 4 contains two magnet rollers 430, specifically, a front magnet roller 431 and a rear magnet roller 432, on both sides of a vertically mounted roller 43 as Illustrated in FIG. 9.

The distance between the axes of the connecting pins 42 retaining the front and rear magnet rollers 431, 432 is made equal to the distance between the centers of the front and rear disc magnets 8*a*, 8*b* mounted on the racing car R in the state where the chain members shown in FIG. 9 are connected together.

Furthermore, the front and rear disc magnets 8*a*, 8*b* mounted on the racing car R come face to face with the front and rear magnet rollers 431, 432 attached to the chain 4 with their unlike poles facing each other, respectively. When the racing car is placed in position on a lane 23 on the plate member 24, the disc magnets 8*a*, 8*b* and magnet rollers 431, 432 are attracted each other, and the racing car R moves on the lane 23 in a stable manner following the movement of the chain 4, without sliding side to side.

In this chain, there is no need to attach the first permanent magnet 44 on top of the link member 41, unlike the chain 4 of FIG. 5. Furthermore, attaching a plurality of magnet rollers 430 to the chain 4 will increase the flexibility in selecting the initial position of the racing car R on the lane 23. There are two each magnet rollers 431, 432 and disc magnets 8*a*, 8*b* in the illustrated example of FIG. 9. However, it may be also possible to provide one each, three each or more magnet rollers 430 and disc magnets 8.

This invention may be embodied in several forms without departing from the spirit of essential characteristics thereof. Accordingly, the embodiments as described above are intended to be only illustrative and not restrictive. The scope of the invention is defined by the appended claims rather than by the description preceding them. All the changes that fall within the metes and bounds of the claims, or equivalents of such metes and bounds are Intended to be embraced by the claims.

What is claimed is:

1. A chain comprising:

a plurality of link members, each of said link members including a pair of first coupling flanges with a counter sink;

each of said link members including a pair of second coupling flanges with a projection;

said projections of said second coupling flanges being formed in a shape to fit into the counter sink of the first coupling flanges to thereby connect the plurality of link members.

2. A chain according to claim 1 wherein a gap is formed between one of said pair of flanges, said other pair of flanges being disposed in said gap.

3. A chain according to claim 2 wherein said other pair of flanges have a generally flat root portion and a generally flat end portion extending from said root portion, said flat end portion being disposed in said gap.

4. A chain according to claim 3 wherein said root portion is thicker than said flat end portion, and further including a step between said root portion and said flat end portions.

* * * * *